US006303076B1

(12) United States Patent
Yamamoto et al.

(10) Patent No.: US 6,303,076 B1
(45) Date of Patent: Oct. 16, 2001

(54) CONTACT MATERIAL FOR CONTACTS FOR VACUUM INTERRUPTER AND METHOD OF MANUFACTURING THE CONTACT

(75) Inventors: Atsushi Yamamoto, Kunitachi; Takashi Kusano, Itabashi-ku; Tsutomu Okutomi, Yokohama; Tsuneyo Seki, Hachioji; Makoto Kataoka, Fuchu, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/379,362

(22) Filed: Aug. 23, 1999

(30) Foreign Application Priority Data

Aug. 21, 1998 (JP) ..... 10-235052
Dec. 2, 1998 (JP) ..... 10-342431
May 28, 1999 (JP) ..... 11-149308

(51) Int. Cl.[7] ..... B22F 3/26
(52) U.S. Cl. ..... 419/14; 419/27
(58) Field of Search ..... 419/14, 27

(56) References Cited

U.S. PATENT DOCUMENTS 4,137,076 * 1/1979 Hoyer et al. ..... 75/241
4,457,780 7/1984 Osada et al. .
5,045,281 9/1991 Okutomi et al. .
5,109,145 * 4/1992 Fujita et al. ..... 200/144 B
5,420,384 * 5/1995 Okutomi et al. ..... 218/68
6,027,821 * 2/2000 Yamamoto et al. ..... 428/546

FOREIGN PATENT DOCUMENTS 0 488 083 6/1992 (EP) .
0 779 636 6/1997 (EP) .

OTHER PUBLICATIONS

International Search Report issued on Nov. 3, 2000, in corresponding European Patent Application No. 99116171.

* cited by examiner

*Primary Examiner*—Daniel Jenkins
(74) *Attorney, Agent, or Firm*—Oblon, Spivak, McClelland, Maier & Neustadt, P.C.

(57) ABSTRACT

A contact material for forming a contact included in a vacuum interrupter comprises 50 to 70% by weight of a conductive material containing Cu as a principal component, an arc-proof material containing at least either TiC or VC and having a mean particle diameter of 8 $\mu$m or below, and 0.2 to 2.0% by weight of Cr on the basis of the sum of the respective amounts of Cr and Cu or 0.2 to 2/0% by weight of Zr on the basis of the sum of the respective amounts of Zr and Cu. The contact material has a hydrogen content in the range of 0.2 to 50 ppm.

22 Claims, 1 Drawing Sheet

CONTACT MATERIAL FOR CONTACTS FOR VACUUM INTERRUPTER AND METHOD OF MANUFACTURING THE CONTACT

BACKGROUND OF THE INVENTION

1. Field of the Invention

The present invention relates to a contact material for forming the contacts of a vacuum interrupter excellent in large current interruption ability, chopping current characteristics, current carrying characteristics and large current carrying characteristics, and to a method of manufacturing the contacts.

2. Description of the Related Art

A vacuum interrupter which interrupts a current by using the property of arcs to diffuse in a vacuum has two opposite, stationary and movable contacts. When interrupting a current flowing through an inductive load circuit, such as an electric motor, by the vacuum interrupter, it is possible that the load circuit is destroyed by an extraordinarily high surge voltage generated upon the interruption of the current.

Such an extraordinarily high surge voltage is generated, for example, by a current chopping phenomenon (forced current interruption before the alternating current decreases to the natural zero point of the ac waveform) that occurs when low current interruption is made in a vacuum or by a high-frequency arc extinguishing phenomenon. A surge voltage $V_s$ generated by a current chopping phenomenon is equal to $Z_o \times I_c$, where $Z_o$ is the impedance of the circuit and $I_c$ is a chopping current. Therefore, the chopping current $I_c$ must be reduced to reduce the abnormal surge voltage $V_s$.

Contacts having a low chopping current characteristics are classified into a Cu—Bi alloy contacts formed by a melting process, and an Ag—WC alloy contacts formed by a sintering-and-infiltration process.

The Ag—WC alloy contact exhibits an excellent low chopping current characteristics in the following respects:

(1) WC facilitates electron emission;

(2) Evaporation of the material forming the contact due to the heating of the surface of the contact by the collision of field emission electrons against the contact is promoted; and (3) The carbide contained in the material forming the contact is decomposed by arcs to generate charged bodies and the charged bodies make the arc continuous. A vacuum circuit interrupter provided with such alloy contacts has recently been developed and applied to practical use.

An Ag—Cu—WC alloy produced by adding Cu to the Ag—WC alloy forming the Ag—WC alloy contact in an Ag/Cu ratio of about 7/3 is proposed in Japanese patent publication JP B2(kokoku) No. S63-59212. This known Ag—Cu—WC alloy having such a specific Ag/Cu ratio has a stable chopping current characteristics.

A technique disclosed in Japanese patent publication JP B2(kokoku) No. H05-61338 suggests that the use of an arc-proof material, such as a WC alloy having a particle size in the range of 0.2 to 1 $\mu$m is effective in improving chopping current characteristics.

The chopping current characteristics of the Cu—Bi alloy contact is improved by the selective evaporation of Bi. A Cu—Bi alloy having a Bi content of 10 percent by weight (hereinafter abbreviated to "% by weight" or "wt %") proposed in Japanese patent publication JP B2(kokoku) No. S35-14974 has a moderate vapor pressure characteristic and hence exhibits a low chopping current characteristics. In a Cu—Bi alloy having a Bi content of 0.5% by weight proposed in Japanese patent publication JP B2(kokoku) No. S41-12131, Bi segregates in grain boundaries, which embrittles the Cu—Bi alloy. Therefore, a contact formed of this Cu—Bi alloy needs a low weld release force and has an excellent large current interruption ability.

Essentially, the vacuum interrupter must be capable of large current interruption. It is important to produce arcs over the entire surfaces of the contacts to limit the amount of input heat per unit area of the contacts to a low level to enable the contacts to achieve large current interruption. One of the means for producing arcs over the entire surfaces of the contacts employs a longitudinal magnetic field electrode structure which creates a magnetic field parallel to an electric field created between electrodes mounted with contacts. According to Japanese patent publication JP B2(kokoku) No. S54-22813, an arc plasma can be distributed uniformly over the surfaces of the contacts by creating an appropriate magnetic field, and large current interruption ability can be enhanced.

According to Japanese patent publication JP A(kokai) No. H04-206121, the mobility of the cathode point of an arc is improved and large current interruption ability is improved when interparticle distances between WC—Co particles of an Ag—Cu—WC—Co alloy are in the range of about 0.3 to about 3 $\mu$m, and the interrupting performance of contacts made of such an alloy is improved when auxiliary ferrous component content, such as Co content, is increased.

The vacuum interrupter is required to be capable of suppressing surges and a low chopping current characteristics has been required of the vacuum interrupter. Cases where the vacuum interrupter is applied to inductive circuits, such as large capacity electric motors, have increased in recent years, and high surge impedance loads have appeared. Consequently, it is desired that the vacuum interrupter has both a further stable low chopping current characteristics and a large current interruption ability.

When contacts made of the Cu—Bi alloy having a Bi content of 10% by weight mentioned in JP B2(kokoku) No. S35-14974 are used, the amount of metal vapor supplied into the space between the electrodes decreases with the increase of current interrupting frequency of the contacts, the low chopping current characteristics deteriorates and deterioration of the withstand voltage characteristics dependent on the amount of an element having a high vapor pressure occurs. The low chopping current characteristics of the Cu—Bi alloy having a Bi content of 0.5% by weight (mentioned in JP B2 No. S41-12131) is unsatisfactory. Thus, it is impossible to provide a stable low chopping current characteristics only by the selective evaporation of the element having a high vapor pressure.

Although a contact material containing Ag as a conductive component, such as an Ag—WC—Co alloy, has a comparatively satisfactory chopping current characteristic, the vapor pressure of the same is excessively high and the same is unable to exercise fully satisfactory interrupting performance. Although the Ag—Cu—WC alloy having the Ag/Cu weight ratio of 7/3 (mentioned in JP B2 No. S63-59212) and a contact material containing Ag as a principal conductive component, such as the Ag—Cu—WC alloy containing particles of an arc-proof component, such as WC particles, having a particle size in the range of 0.2 to 1 $\mu$m (mentioned in JP B2 No. H05-61338) are excellent in interruption ability and chopping current characteristics, contacts made of those alloys are expensive. Increase in the Co content of those contact materials to improve the interrupting performance entails the reduction of the low chopping current characteristic.

On the contrary, a contact material containing Cu, which is inexpensive, as a conductive component, is comparatively satisfactory in interrupting ability, however, the chopping current characteristics of the contact material is unsatisfactory unless the arc-proof component content is increased. For example, the porosity of a WC skeleton is reduced by adding Co to the WC skeleton when sintering the WC skeleton for the Cu—WC—Co alloy to suppress the infiltration of Cu into the WC skeleton.

However, components for promoting the sintering of carbides, such as Co, Fe and Ni, reduce the conductivity of Cu and hence the current carrying characteristic of the alloy is deteriorated greatly if the alloy contains those components excessively.

SUMMARY OF THE INVENTION

Accordingly, it is an object of the present invention to provide a contact material for forming the contacts of a vacuum interrupter, having an excellent large current interruption ability, a low chopping current characteristics and a large current carrying characteristic, and to provide a method of manufacturing the contact.

According to a first aspect of the present invention, a contact material is provided which contains 50 to 70% by weight of conductive components including Cu as a principal component, 30 to 50% by weight of at least either TiC or VC as an arc-proof component having a mean particle diameter of 8 $\mu$m or below, and 0.2 to 2.0% by weight of Cr relative to the sum of the respective amounts of Cr and Cu or 0.2 to 2.0% by weight of Zr on the basis of the sum of the respective amounts of Zr and Cu, wherein the contact material has a hydrogen content in the range of 0.2 to 50 ppm.

Since the atomic weight of Cu is smaller than that of Ag and Cu has a lower vapor pressure than that of Ag, a contact made of a contact material containing Cu as a conductive component has the property of restoring insulation after interruption higher than that of a contact made of a contact material containing Ag as a conductive component, such as an Ag—WC alloy. However, the former contact is inferior to the latter in low chopping current characteristics. Therefore, a low chopping current characteristics substantially equal to that of an Ag—WC alloy can be maintained by employing TiC superior in low chopping current characteristics to WC. Generally, Cu and TiC are inferior in wettability. However, when Cr or Zr is contained in Cu(liquid) and lies in the TiC/Cu boundary, the wettability of Cu and TiC is improved and an infiltration process can be used.

If a Cu—TiC alloy forming a contact has a large hydrogen content, the large current interruption ability of the contact is deteriorated greatly. Therefore, it is essential that the hydrogen content is limited to 50 ppm or below. If the Cu—TiC alloy is produced in a vacuum atmosphere of $10^{-2}$ Pa or above which can be achieved by a vacuum system including a diffusion pump and employed in a general vacuum heat treatment process, the hydrogen content of the Cu—TiC alloy is 0.2 ppm or above. Heat treatment in a higher vacuum atmosphere is not preferable because such heat treatment is very costly, and the Ti/TiC ratio increases due to the decomposition of carbides to deteriorate chopping current characteristics.

The Cu—TiC—Cr or Cu—TiC—Zr alloy provided by the present invention has an excellent large current interruption ability, an excellent large current carrying ability and an excellent low chopping current characteristics comparable to that of an Ag—WC alloy, and is inexpensive because the alloy contains Cu as a conductive component.

According to a second aspect of the present invention, a method of manufacturing a contact for a vacuum interrupter is provided which includes the steps of: forming a skeleton from a powder containing at least TiC or VC as a principal component and having a mean particle diameter of 8 $\mu$m or below; and infiltrating the skeleton with an infiltrating material containing a Cu-base alloy having a Cr content in the range of 0.2 to 2.0% by weight or a Cu-base alloy having a Zr content in the range of 0.2 to 2.0% by weight so that the contact comprises 30 to 70% by weight of the skeleton and 50 to 70% by weight of the infiltrating material. A method of infiltrating the skeleton with a Cu—Cr or Cu—Zr alloy is the simplest, optimum method of collecting and homogeneously distributing Cr or Zr in the Cu/TiC boundary.

The skeleton may be formed of a powder containing 0.25 to 2.3% by weight of Cr or Zr instead of infiltrating the skeleton with the foregoing infiltrating material containing Cr or Zr. Cr and Zr contained in Cu(liquid) during an infiltration process are effective in improving the wettability of the Cu/TiC boundary. Therefore, Cr or Zr contained in the powder forming the skeleton dissolves in liquid Cu at the start of infiltration and improves the wettability of the skeleton effectively.

Cu as a conductive component may be contained in the powder for forming the skeleton in addition to being contained in the infiltrating material. When the skeleton is formed of a powder containing Cu, it is preferable that the Cu content of the powder is in the range of 10 to 40% by weight. When the skeleton is formed of the powder containing Cu, the wettability of Cu and TiC is further improved.

Preferably, the sintering process and the infiltration process are carried out in a vacuum atmosphere. It is preferable to prevent the sintered body and the infiltrating material from coming into contact with carbon in the vacuum atmosphere. If the skeleton is subjected to the sintering process and the infiltration process in an atmosphere containing hydrogen which is often used for manufacturing an Ag—WC alloy, hydrogen contained in the atmosphere is combined with TiC to deteriorate interrupting ability greatly because Ti is a hydrogen-absorbing element. Accordingly the sintering process and the infiltration process must be carried out in a vacuum atmosphere. When a Cu—TiC alloy containing Cr or Zr is processed with hydrogen, Cr or Zr contained in the infiltrating material is made to react with carbon contained in the material forming the furnace or the crucible by the agency of hydrogen to form a film of Cr carbide or Zr carbide. The Cr carbide or Zr carbide obstructs the flow of infiltrating material in the liquid phase and, consequently, the skeleton cannot satisfactorily infiltrated with the infiltrating material. Thus, it is improper to carry out the infiltration process in a hydrogen atmosphere.

When the infiltrating material contains Cr or Zr, the infiltrating material is attracted to the highly wettable carbon material forming the crucible when the infiltrating material comes into contact with the crucible and, consequently, the skeleton cannot satisfactorily be infiltrated with the infiltrating material. Therefore, it is preferable to use a furnace or a crucible formed of a material not containing carbon or to isolate the furnace or the crucible from the infiltrating material by alumina powder to avoid the contact of the infiltrating material with carbon.

It is preferable to use a split mold for forming the skeleton. When forming a contact of an Ag-base alloy e.g., Ag—WC—Co alloy, it is possible to limit the conductive component infiltrated into voids of a WC skeleton to a small amount by increasing the density of the sintered WC skeleton and reducing the void of the sintered WC skeleton by the sintering promoting action of Co. Consequently, the arc-proof component content of the contact can be increased. However, when forming a contact of a Cu-base alloy containing Cu as a conductive component, sintering promoting components, such as Co, Fe and Ni, dissolve in Cu to form a solid solution to reduce the conductivity of the contact, which deteriorates current carrying ability greatly. Furthermore, the thermion emitting performance of the arc-proof component is obstructed by Co coating particles of the arc-proof component, whereby current chopping characteristic is deteriorated.

The present invention does not use any sintering promoting material when molding the skeleton and increases the density of the skeleton of the arc-proof material so as to prevent the deterioration of current carrying ability and low chopping current characteristics. Generally, the coarser a carbide powder, the easier to form a molding of the carbide powder in a high density. However, a fine carbide powder must be used for forming a contact having a stable low chopping current characteristics because the respective chopping current characteristics of contacts formed of a coarse carbide powder are distributed in a wide range. The fine carbide powder must be molded by a high molding pressure to form a molding having a high density. Generally, an extrusion mold is used for molding a contact material. When a carbide powder is extruded through an extrusion mold for molding by a high pressure, the molding is liable to be cracked when the same is extruded through the extrusion mold. If a hydrocarbon binder, such as a paraffin, is used to prevent the molding from cracking, hydrogen contained in the paraffin and hydrogen gas contained in an atmosphere for a paraffin removing process is combined with the material forming the molding, whereby the interrupting ability is deteriorated greatly. When a split mold is used for molding the contact material, the split mold is split and a molding is taken out of the split mold without cracking the molding. Thus, a perfect molding of a high density can be formed without using any binder, such as a paraffin.

According to a third aspect of the present invention, a method of manufacturing a contact material for a vacuum interrupter containing 40 to 55 percent by volume (hereinafter abbreviated to "% by volume" or "vol %") of conductive material containing Cu as a principal component and 45 to 60% by volume of an arc-proof material containing TiC or VC as a principal component is provided which includes: a mixing process for producing a mixed powder by mixing powder of the arc-proof material of particle sizes in the range of 0.3 to 3 $\mu$m, Cu powder and powder of a paraffin; a molding process for molding the mixed powder in a skeletal molding; and an infiltration process for infiltrating the skeletal molding with a conductive material; wherein the amount of Cu powder used in the mixing process corresponds to a Cu content in the range of 16 to 43% by volume of the sum of the amount of the arc-proof powder and that of the Cu powder, and the amount of the paraffin powder used in the mixing process corresponds to a paraffin content in the range of 5 to 30% by volume of the sum of the amount of the arc-proof material and that of the Cu powder.

The inexpensive contact material suitable for mass production and having a large current interruption ability, an excellent chopping current characteristic and a large current carrying ability can be manufactured. This contact material manufacturing method uses the mixed powder containing the paraffin powder for forming the molding to improve the moldability of TiC powder or VC powder, so that moldings are not cracked and can stably be manufactured even if the moldings are formed by using a compression mold.

Preferably, the particle size of the Cu powder added to the arc-proof powder in the mixing process is 100 $\mu$m or below. The finer the Cu powder, the smaller is the porosity of the molding, the smaller is the amount of Cu infiltrated into the molding and the smaller is the Cu content of the contact. When the particle size of the Cu powder is 100 $\mu$m or below, the Cu content of the contact can be limited to a value not greater than an upper limit Cu content (50% by volume) determined to secure a predetermined chopping current characteristic.

The paraffin added to the arc-proof powder in the mixing process must be removed. In view of the maintenance of a furnace, a deparaffinizing process is carried out under the atmospheric pressure. If the deparaffinizing process is carried out in a hydrogen atmosphere, part of the Ti carbide is converted into Ti hydride. Consequently hydrogen is contained in the contact and affect seriously adversely to the interrupting ability of the contact.

To avoid such a problem, it is preferable to subject the molding formed by the molding process to a deparaffinizing process before subjecting the same to the infiltration process. In the deparaffinizing process the molding is held at a temperature in the range of 300 to 500° C. in a nitrogen atmosphere for 10 min or longer to remove the paraffin by evaporation from the molding. When the molding is thus processed in the nitrogen atmosphere by the deparaffinizing process, gases detrimental to interrupting characteristic, such as hydrogen gas, are eliminated from the contact, and a contact capable of exercising an excellent interrupting ability can be obtained.

The infiltration process is carried out after the deparaffinizing process. In the infiltration process, the conductive material containing Cu as a principal component is infiltrated into the molding in a vacuum at a temperature in the range of 1100 to 1200° C., thereby the hydrogen content of the contact is molding further reduced.

Even if the paraffin is removed by a deparaffinizing process using a hydrogen atmosphere and the hydrogen content of the contact is increased, hydrogen can be removed from the contact by the following deparaffinizing and dehydrogenating processes instead of the foregoing deparaffinizing process in the nitrogen atmosphere. In this case, in the deparaffinizing process, paraffin is removed by holding the molding in a hydrogen atmosphere at a temperature not lower than 300° C. and not higher than the melting point of the conductive material to be infiltrated into the molding for 10 min or longer to evaporate the paraffin before subjecting the molding to the infiltration process. Next, in the dehydrogenating process, the molding is held in a vacuum at a temperature not lower than 900° C. and not higher than the melting point of the material infiltrated into the molding for 30 min or longer. Thus, a contact having a small hydrogen content and capable of exercising an excellent interrupting ability can be obtained.

The paraffin can be removed by a chemical paraffin removing method instead of using the foregoing thermal paraffin removing method. The paraffin can be removed from the molding by immersing and holding the molding in a hydrocarbon cleaning liquid of a boiling point in the range of 50 to 200° C. heated at a temperature not lower than 40° C. and not higher than the boiling point of the hydrocarbon cleaning liquid to extract the paraffin from the molding. Thus, the contact having a small hydrogen content and capable of exercising an excellent interrupting ability can be obtained.

When removing the paraffin by the foregoing chemical method, the paraffin extracting rate of the hydrocarbon cleaning liquid having a boiling point in the range of 50 to 200° C., such as n-hexane, is dependent on the paraffin concentration of the cleaning liquid. Therefore, it is essential to pay attention to keeping the paraffin concentration of the cleaning liquid low to maintain a high paraffin extracting rate. Therefore, it is preferable to change the cleaning liquid at least once during the deparaffinizing process or to transfer from the cleaning liquid to a cleaning liquid having a lower paraffin concentration. Thus, time necessary for removing the paraffin can be reduced and thereby contact material manufacturing cost can be reduced.

The porosity of the molding to be infiltrated with Cu can be reduced by using the fine Cu powder in the mixing process. It is also possible to reduce the porosity by sintering. A sintering additive must be added to the mixture to make the molding shrink by sintering. A sintering additive, such as Co, Fe, Ni or Cr, dissolves in Cu to produce a solid solution which reduces the conductivity of Cu and affects adversely to current carrying ability. Therefore, the least necessary amount of sintering additive must be used.

When a mixture containing a sintering additive is used, it is preferable that the mixture has a Co content of 0.1% by weight or below, an Fe content of 0.1% by weight or below, an Ni content of 0.3% by weight or below or a Cr content of 3% by weight or below. When the sintering additive is added to the mixture in an additive content not greater than the predetermined additive content, the Cu content of the contact can be limited to a value not greater than 50% by volume, and the contact is able to exercise an excellent chopping characteristic.

If the molding is infiltrated with an excessively large amount of the infiltrating material in the infiltration process, it sometimes occurs that the surplus infiltrating material solidifies on the surface of the molding and causes the molding to crack when the surplus infiltrating material shrinks as the same solidifies. Therefore it is preferable that the amount of the infiltrating material to be used for infiltrating the molding is in the range of 100 to 110% of the amount of the infiltrating material necessary to fill up all the pores of the molding. When the molding is infiltrated with such an amount of the infiltrating material, the molding will not be cracked when the infiltrating material solidifies and a stable contact material can be manufactured.

It is thought that cracks are formed in the molding because the molding is pushed back by the side surface of the mold when molding pressure is removed. Such a force pushing the molding can be reduced by forming the opposite ends of the cavity of the mold in different diameters, respectively, so that the diameter of one end of the cavity is greater than that of the other end of the same, and the cavity is tapered. Accordingly, it is preferable to form the mold to be used for molding the mixed powder in a molding having the shape of a disk in the molding process in construction that permits the molding to be extracted from the mold, and to form one mold from which the molding is extracted in an inside diameter greater than that of the other mold. Formation of cracks in the molding can be suppressed and a stable contact material can be manufactured by using such a molding.

BRIEF DESCRIPTION OF THE DRAWINGS

The above and other objects, features and advantages of the present invention will become more apparent form the following description taken in connection with the accompanying drawings, in which.

DESCRIPTION OF THE PREFERRED EMBODIMENTS

Vacuum Interrupter

Figure 1:
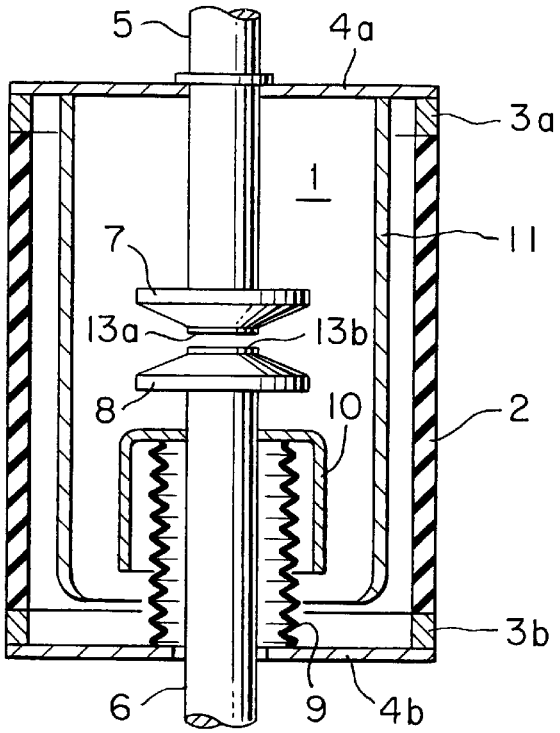
FIG. 1 is a sectional view of a vacuum interrupter provided with contacts in a preferred embodiment according to the present invention.
Figure 2:
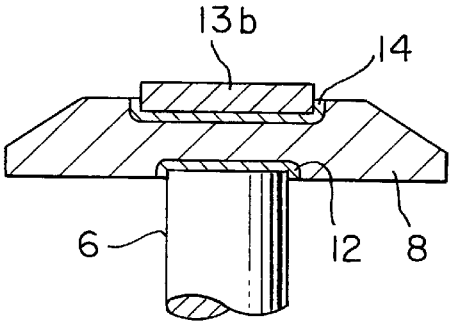
FIG. 2 is an enlarged sectional view of an electrode included in the vacuum interrupter shown in FIG. 1.

Referring to FIG. 1 showing a vacuum interrupter provided with contacts in accordance with the present invention, sealing members 3*a* and 3*b* are put on the opposite ends of a substantially cylindrical, insulating vacuum envelope 2 formed of an insulating material, respectively. A metal covers 4*a* and 4*b* are put on the sealing members 3*a* and 3*b*, respectively, to define a sealed, vacuum interrupting chamber 1. Conductive rods 5 and 6 are disposed coaxially in the interrupting chamber 1, and a pair of electrodes 7 and 8 are attached to the ends of the conductive rods 5 and 6 facing each other, respectively. The upper electrode 7, as viewed in FIG. 1, is a fixed electrode and the lower electrode 8, as viewed in FIG. 1, is a movable electrode. A bellows 9 is attached to the conductive rod 6 holding the electrode 8 to move the conductive rod 6 axially in the interrupting chamber 1 without breaking a vacuum created in the breaking chamber 1. The bellows 9 is protected by an arc shield 10 made of a metal. The arc shield 10 prevents the bellows 9 from being covered with an arc vapor. An arc shield 11 of a metal is disposed in the interrupting chamber 1 so as to cover the electrodes 7 and 8 to prevent the insulating vessel 2 from being covered with an arc vapor. As shown in FIG. 2, the electrode 8 is fixedly attached to the conductive rod 6 by brazing using a brazing alloy 12 or by staking. A contact 13*a* is attached to the electrode 8 by brazing using a brazing alloy 14. Similarly, a contact 13*b* is attached to the electrode 7 by brazing.

First Embodiment

A first embodiment of the present invention will be described in connection with the results of experiments.

Sample Alloy Contacts

Sample alloy contacts containing TiC as an arc-proof component in examples of the present invention and comparative examples were made. Process conditions for making the sample contacts are tabulated in Tables 1 and 2. Arc-proof TiC powders of different particle sizes and auxiliary materials of different particle sizes were used. The TiC powders and the auxiliary materials respectively having specified particle sizes were prepared by using a sieving process and a settling process in combination.

Each of powder mixtures for forming alloy contacts in Examples 13 to 15 and Comparative examples 8 and 9 was prepared by mixing a predetermined amount of TiC powder of a predetermined particle size and a predetermined amount of a Cr powder of a predetermined particle size.

Mean particle diameter of each of the powders is measured, before the mixing process, by "laser diffraction and scattering method" employing a "particle size distribution measurement apparatus" (Type: LA-700, HORIBA SEISAKUSHO KA-BUSIKI KAISHA, Japan).

Each of mixtures for forming skeletons for the alloy contacts in Examples 16 to 18 and Comparative examples 10 and 11 was prepared by mixing a predetermined amount of a TiC powder of a predetermined particle size and a predetermined amount of a Cu powder. Compacts were made by compacting the powder mixtures. The compact for the alloy contact in Example 15 was formed by using an extrusion mold, and those for the rest were formed by using a split mold.

The compacts were sintered by heating the same at a predetermined temperature, for example, 1150° C., for a predetermined time, for example 1 hr, to obtain porous skeletons.

The skeletons for the alloy contacts in Examples 13 to 15 and Comparative examples 7 and 8 were infiltrated with Cu, and the skeletons for the alloy contacts in Examples 16 to 18 and Comparative example 10 and 11 were infiltrated with a Cu—Cr alloy by an infiltration process to obtain the desired alloy contacts in Examples 13 to 18 and Comparative examples 7 to 10. The skeletons were heated at 1150° C. for 1 hr in the infiltration process.

The infiltration processes for the skeletons for the alloy contacts in Example 20 and Comparative examples 11 and 12 were carried out in a hydrogen atmosphere, and those for the rest were carried out in an evacuated atmosphere. The infiltration processes for processing the skeletons for the alloy contacts in examples and comparative examples excluding Comparative example 3 were carried out in an evacuated atmosphere of a vacuum of $1.7\times10^{-3}$ Pa at 1000° C. created by using a diffusion pump and an oil rotary pump.

Each of infiltrating materials containing Cu and used in the infiltration processes was prepared by cutting an ingot obtained by melting a mixture of materials mixed in a predetermined mixing ratio at a predetermined temperature by vacuum melting process.

The skeleton for the alloy contact in Example 21 was subjected to the infiltration process in a furnace provided with an alumina core tube. The skeletons for the rest were subjected to the infiltration process in a stainless steel furnace having walls lined with a refractory material of carbon. The skeleton for the alloy contact in Example 20 was placed in an alumina boat and those for the alloy contacts in the other examples and comparative examples were contained in a carbon boat when the same are processed in the furnace for infiltration. The boats for the skeletons for the alloy contacts in the examples and the comparative examples were powdered with an alumina powder. The boats for the alloy contacts in Example 20 and Comparative example 14 were not powdered.

Note, hydrogen contents in each of the contacts is measured by thermal conductivity method specified in JIS Z 2614(1990) 2.2(d).

Tests for Evaluating Sample Alloy Contacts (1) Chopping Current Characteristic Test A knockdown vacuum interrupter provided with the sample alloy contacts was built and was evacuated to a vacuum of $10^{-5}$ Pa or higher. The contacts of the vacuum interrupter were parted at a contact parting speed of 0.8 m/s to interrupt a small lagging current and a chopping current was measured. The interrupting current was 20 A (effective value) and 50 Hz. The contact parting operation was executed at random phases by 500 cycles. Three pairs of contacts in each of the examples and comparative examples were tested. Measured results are tabulated in Table 4. Values shown in Table 4 are relative values obtained by normalizing maximum measured values by the maximum value for Example 2. The alloy contacts having the relative values less than 2.0 are regarded as acceptable.

(2) Current Carrying Ability Test

A current of 1000 A was supplied to the vacuum valve until the temperature of the vacuum interrupter settled. The current carrying characteristic was evaluated on the basis of a temperature increase when the vacuum interrupter settled at the temperature. Values shown in Table 4 are relative values obtained by normalizing measured temperature increases by the temperature increase in the vacuum interrupter provided with the alloy contacts in Example 2. The alloy contacts caused a temperature increase represented by the relative value less than 2.0 are regarded as acceptable.

(3) Large Current Interruption Ability Test

Circuit breaking tests were carried out according to Test Method No. 5 specified in JEC Standards. The compositions of the materials forming the sample alloy contacts and the results of the tests (1) to (3) are tabulated in Tables 3 and 4.

Examination of Experimental Results

The composition of the material forming each of the alloy contacts and data on the characteristics of the alloy contacts will be examined with reference to Tables 1 to 4.

Re: Examples 1 to 3 and Comparative Examples 1 and 2

The infiltrating material for Examples 1 to 3 and Comparative example 1 and 2 was a Cu-1 wt %Cr alloy. The arc-proof material had a mean particle diameter of 1.3 $\mu$m. The relative densities of the skeletons were adjusted to vary arc-proof component content in the range of 24.2 to 53.3% by weight.

Examples 1 to 3 respectively having an arc-proof component content in the range of 30 to 50% by weight were satisfactory in breaking characteristic, chopping characteristic and current carrying characteristic.

The interrupting ability of Comparative example 1 having an arc-proof component content greater than those of Examples 1 to 3 was rejectable.

The relative maximum interrupting current of Comparative example 2 having an arc-proof component content smaller than hose of Examples 1 to 3 was greater than 2.0.

Re: Examples 4 to 6 and Comparative Examples 3 and 4

The infiltrating material for Examples 4 to 6 and Comparative examples 3 and 4 was a Cu-1 wt %Cr alloy. An arc-proof material having a mean particle diameter of 1.3 $\mu$m was used. The alloys forming the alloy contacts had a conductive component content (Cu+Cr content) of 60% by weight and an arc-proof component content (TiC content) of about 40% by weight. Cu—TiC alloys respectively having different hydrogen contents in the range of 0.1 to 70 ppm were produced by using TiC powders exposed to the atmosphere for different periods, respectively, before being infiltrated into the skeletons, and adjusting the degree of vacuum at 100° C. immediately before infiltration.

All Examples 4 to 6 using the Cu—Ti alloys having hydrogen contents in the range of 0.2 to 50 ppm were satisfactory in current interrupting ability, chopping current characteristic and current carrying ability. Comparative example 3 using the Cu—Ti alloy having a hydrogen content of 0.1 ppm was unsatisfactory in chopping current characteristic and was rejectable.

The infiltration process must be carried out in a high vacuum of $1.7\times10^{-3}$ Pa to reduce the hydrogen content to a value to that of the Cu—TiC used by Comparative example 3. However, it was found that TiC is decarburized in such a high vacuum and Ti is produced and, consequently, the chopping current characteristic is deteriorated. Moreover, equipment for creating a high vacuum suitable for mass-production is very expensive and use of such expensive equipment increases manufacturing cost and is economically disadvantageous.

Comparative example 4 using a Cu—TiC alloy having a hydrogen content of 70 ppm emitted hydrogen gas when the contacts were parted and the interruption ability was rejectable.

Re: Examples 7 to 9 and Comparative Example 5

All those alloy contacts were formed by using a Cu-1 wt %Cr alloy as the infiltrating material The alloy forming the alloy contacts had a conductive component content (Cu+Cr content) of 60% by weight and an arc-proof component content (TiC content) of about 40% by weight. Arc-proof materials respectively having a mean particle diameter in the range of 0.8 to 10 μm were used. The composition was adjusted by adjusting molding pressure.

Examples 7 to 9 using the arc-proof materials having mean particle diameter not greater than 8 μm were satisfactory in interrupting ability and chopping current characteristics.

The interrupting ability of Comparative example 5 using the arc-proof material having a mean particle diameter of 10 μm was rejectable.

Re: Examples 10 to 12 and Comparative Examples 6 and 7

All those alloy contacts were formed by using a Cu—Cr alloy as the infiltrating material, and an arc-proof material having a mean particle diameter of 1.3 μm. The alloys forming the alloy contacts had a conductive component content (Cu+Cr content) of 60% by weight and an arc-proof component content (TiC content) of about 40% by weight. An arc-proof material having a mean particle diameter of 0.8 μm was used. Infiltrating materials respectively having Cr contents in the range of 0.15 to 2.90% by weight relative to the sum of the respective amounts of Cu and Cr were used.

The skeletons of Examples 10 to 12 using the infiltrating materials having Cr contents (relative to the sum of the respective amounts of Cu and Cr) in the range of 0.2 to 2.0% by weight were infiltrated satisfactorily with the infiltrating materials.

In Comparative example 6 using the infiltrating material having a Cr content of 0.15% by weight (relative to the sum of the respective amounts of Cu and Cr) the action of Cr is not fully effective. Consequently, Comparative example 6 was excessively porous and its current carrying ability was unsatisfactory.

In Comparative example 7 having an excessively large Cr content of 2.90% by weight, the excessive Cr dissolves in Cu to produce a solid solution. Consequently, Comparative example 7 has a very low conductivity, a bad current carrying ability and rejectable interruption ability.

Re: Examples 13 to 15 and Comparative Examples 8 and 9

All those alloy contacts were formed by using a Cu as the infiltrating material, and an arc-proof material having a mean particle diameter of 1.3 μm. The alloys forming the alloy contacts had a conductive component content (Cu+Cr content) of 60% by weight and an arc-proof component content (TiC content) of about 40% by weight. The Cr content relative to the sum of conductive components in the alloy (i.e., relative to the sum of the respective amounts of Cu and Cr in the alloy) was varied in the range of 0.15 to 3.50% by weight, by adjusting the Cr content of the skeletons.

The skeletons of the arc-proof material of Examples 13 to 15 having a Cr content in the range of 0.25 to 2.5% by weight (relative to the sum of conductive components) are infiltrated with the conductive material satisfactorily.

The action of Cr contained in the conductive component of Comparative example 8 having a Cr content of 0.15% by weight is not fully effective and Comparative example 8 had excessively porous structure and hence the current carrying ability thereof was unsatisfactory.

In Comparative example 9 having an excessively large Cr content of 3.5% by weight, excessive Cr dissolves in Cu to produce a solid solution. Consequently, conductivity was very low, current carrying ability was bad and interrupting ability was rejectable.

Re: Examples 16 to 18 and Comparative Examples 10 and 11

An arc-proof material having a mean particle diameter of 1.3 μm was used. Skeletons containing Cu in Cu contents in the range of 5.5 to 42.5% by weight were used. A Cu-1 wt % Cr alloy was used as an infiltrating material. The relative densities of the skeletons were adjusted so that the contact alloys had a conductive component content (Cu+Cr content) of 60% by weight. and an arc-proof component content (TiC content) of about 40% by weight.

In Examples 16 to 18 using the skeletons respectively having Cu contents in the range of 10 to 40% by weight, the skeletons formed of the arc-proof materials are infiltrated satisfactorily with the conductive material.

The skeleton of Comparative example 10 having a Cu content of 5.5% by weight. was incompletely infiltrated with the conductive material and Comparative example 10 was not a suitable sample for characteristic evaluation.

Comparative example 11 having a n excessively large Cu content of 42.5% by weight had very inhomogeneous structure, and the relative value of the maximum chopping current exceeded 2.0.

Re: Example 19 and Comparative Example 12

Example 19 and Comparative example 12 were formed by using an arc-proof material having a mean particle diameter of 1.3 μm, skeletons having a Cu content of 16% by weight, and an Cu-1 wt %Cr alloy as an infiltrating material. The relative densities of the skeletons were adjusted so that the contact alloys had a conductive component content (Cu+Cr content) of 60% by weight and an arc-proof component content (TiC content) of about 40% by weight.

The skeleton of Example 19 and the infiltrating material were placed in a carbon boat lined with alumina powder and the skeleton was subjected to an infiltration process in a carbon furnace in a vacuum.

The skeleton of Comparative example 12 and the infiltrating material were placed in a carbon boat lined with alumina powder and the skeleton was subjected to an infiltration process in a carbon furnace in a hydrogen atmosphere.

The skeleton of Example 19 was infiltrated satisfactorily with the infiltrating material. The surface of the infiltrating material for Comparative example 12 was coated with a Cr carbide film and the skeleton for Comparative example 12 was not infiltrated properly and Comparative example 12 was not suitable for evaluation.

Re: Example 20 and Comparative Example 13

Example 20 and Comparative example 13 were formed by using an arc-proof material having a mean particle diameter of 1.3 μm, skeletons having a Cu content of 16% by volume, and an Cu-1 wt %Cr alloy as an infiltrating material. The relative densities of the skeletons were adjusted so that the contact alloys had a conductive component content (Cu+Cr content) of 60% by weight and an arc-proof component content (TiC content) of about 40% by weight.

The skeleton of Example 20 and the infiltrating material were placed in an alumina boat and the skeleton was subjected to an infiltration process in an alumina furnace in a hydrogen atmosphere.

The skeleton of Comparative example 13 and the infiltrating material were placed in a carbon boat lined with alumina powder and the skeleton was subjected to an infiltration process in a carbon furnace in a hydrogen atmosphere.

The skeleton of Example 20 was infiltrated satisfactorily with the infiltrating material.

The surface of the infiltrating material for Comparative example 13 was coated with a Cr carbide film and the skeleton for Comparative example 13 was not infiltrated properly and Comparative example 13 was not suitable for evaluation.

Re: Example 21 and Comparative Example 14

Example 21 and Comparative example 14 were formed by using an arc-proof material having a mean particle diameter of 1.3 $\mu$m, skeletons having a Cu content of 16% by volume, and an Cu-1 wt %Cr alloy as an infiltrating material. The relative densities of the skeletons were adjusted so that the contact alloys had a conductive component content (Cu+Cr content) of 60% by weight and an arc-proof component content (TiC content) of about 40% by weight. The skeleton of Example 21 and the infiltrating material were placed in a carbon boat lined with alumina powder and the skeleton was subjected to an infiltration process in an carbon furnace in a vacuum.

The skeleton of Comparative example 14 and the infiltrating material were placed directly in a carbon boat and the skeleton was subjected to an infiltration process in a carbon furnace in a vacuum.

The skeleton of Example 21 was infiltrated satisfactorily with the infiltrating material.

The surface of the infiltrating material for Comparative example 14 was coated with a Cr carbide film and the skeleton for Comparative example 14 was not infiltrated properly and Comparative example 14 was not suitable for evaluation.

Re: Example 22 and Comparative Example 15

Example 22 and Comparative example 15 were formed by using an arc-proof material having a mean particle diameter of 0.8 $\mu$m, skeletons having a Cu content of 16% by volume, and an Cu-1 wt %Cr alloy as an infiltrating material. The relative densities of the skeletons were adjusted so that the contact alloys had a conductive component content (Cu+Cr content) of 60% by weight and an arc-proof component content (TiC content) of about 40% by weight.

A satisfactory compact for Example 22 was formed by using a split mold. A compact for Comparative example 15 formed by using an extrusion mold was cracked and inhomogeneous. Thus Comparative example 15 was unsuitable for evaluation.

As apparent from the foregoing description, the contact manufacturing method manufactures a contact for a vacuum interrupter by molding powder of an arc-proof contact material, such as TiC or VC, containing a small amount of Cr as an additive in a compact, sintering the compact in an atmosphere in which Cr will not be combined with carbon to obtain a skeleton of an arc-proof material, and infiltrating the skeleton with a conductive material. Cr contained in the arc-proof material improves the wettability of TiC and Cu and promotes the infiltration of Cu into the skeleton.

Results of evaluation of contacts formed of an arc-proof material containing VC and those formed of a compound arc-proof material containing TiC and VC were the same as those of the evaluation of the contacts formed of the arc-proof materials containing TiC described above. The effect of addition of Zr was the same as that of addition of Cr.

TABLE 1

| | Composition of Infiltrating Material (wt %) | | Composition of Skeleton (wt %) | | | Relative Density of Skelton | Quality of |
|---|---|---|---|---|---|---|---|
| | Cu | Cr | Tic | Cu | Cr | (%) | Contact |
| Comparative example 1 | 99.0 | 1.02 | 87.0 | 13.0 | 0.00 | 73.0 | good |
| Example 1 | 99.0 | 0.96 | 87.0 | 13.0 | 0.O0 | 70.0 | good |
| Example 2 | 99.0 | 1.03 | 87.0 | 13.0 | 0.00 | 55.5 | good |
| Example 3 | 99.0 | 1.O1 | 87.0 | 13.0 | 0.00 | 47.5 | good |
| Comparative example 2 | 99.0 | 0.98 | 87.0 | 13.0 | 0.00 | 39.7 | good |
| Comparative example 3 | 99.0 | 1.01 | 74.0 | 26.0 | 0.00 | 63.5 | good |
| Example 4 | 99.0 | 0.99 | 74.0 | 26.0 | 0.00 | 63.8 | good |
| Example 5 | 99.0 | 1.03 | 74.0 | 26.o | 0.00 | 64.1 | good |
| Example 6 | 99.0 | 1.02 | 74.0 | 26.0 | 0.00 | 63.9 | good |
| Comparative example 4 | 99.0 | 0.97 | 74.0 | 26.0 | 0.00 | 64.5 | good |
| Example 7 | 99.0 | 1.02 | 74.0 | 26.0 | 0.00 | 64.2 | good |
| Example 8 | 99.0 | 1.01 | 74.0 | 26.0 | 0.00 | 63.9 | good |
| Example 9 | 99.0 | 1.00 | 74.0 | 26.0 | 0.00 | 64.3 | good |
| Comparative example 5 | 99.0 | 0.99 | 74.0 | 26.0 | 0.00 | 64.4 | good |
| Comparative example 6 | 99.9 | 0.15 | 74.0 | 26.0 | 0.00 | 63.7 | Excessively porous |
| Example 10 | 99.8 | 0.22 | 74.0 | 26.0 | 0.00 | 63.9 | good |
| Example 11 | 98.9 | 1.10 | 74.0 | 26.0 | 0.00 | 64.5 | good |
| Example 12 | 98.1 | 1.90 | 74.0 | 26.0 | 0.00 | 64.2 | good |
| Comparative example 7 | 97.1 | 2.90 | 74.0 | 26.0 | 0.00 | 64.0 | good |
| Comparative example 8 | 100.0 | 0.00 | 73.9 | 26.0 | 0.15 | 64.2 | Excessively porous |
| Example 13 | 100.0 | 0.00 | 73.8 | 26.0 | 0.25 | 64.5 | good |
| Example 14 | 100.0 | 0.00 | 73.0 | 26.0 | 1.00 | 64.8 | good |
| Example 15 | 100.0 | 0.00 | 71.7 | 26.0 | 2.30 | 64.7 | good |
| Comparative example 9 | 100.0 | 0.00 | 70.5 | 26.0 | 3.50 | 65.0 | good |
| Comparative example 10 | 99.0 | 0.97 | 94.5 | 5.5 | 0.00 | 58.1 | Faulty infiltration |
| Example 16 | 99.0 | 0.99 | 89.9 | 10.1 | 0.00 | 55.5 | good |
| Example 17 | 99.0 | 1.01 | 75.5 | 24.5 | 0.00 | 63.5 | good |
| Example 18 | 99.0 | 1.03 | 60.4 | 39.6 | 0.00 | 72.9 | good |
| Comparative example 11 | 99.0 | 1.00 | 57.5 | 42.5 | 0.00 | 74.1 | good |
| Comparative example 12 | 99.0 | 0.99 | 83.5 | 16.5 | 0.00 | 60.0 | Faulty infiltration |
| Example 19 | 99.0 | 0.98 | 83.7 | 16.3 | 0.00 | 60.0 | good |
| Comparative example 13 | 99.0 | 1.02 | 83.3 | 16.7 | 0.00 | 59.8 | Faulty infiltration |
| Example 20 | 99.0 | 1.03 | 83.4 | 16.6 | 0.00 | 59.9 | good |
| Comparative example 14 | 99.0 | 1.01 | 83.2 | 16.8 | 0.00 | 58.9 | Faulty infiltration |
| Example 21 | 99.0 | 1.01 | 83.8 | 16.2 | 0.00 | 58.8 | good |
| Comparative example 15 | 99.0 | 1.03 | 83.5 | 16.5 | 0.00 | 58.9 | Skeleton is cracked |
| Example 22 | 99.0 | 0.99 | 83.6 | 16.4 | 0.00 | 58.7 | good |

TABLE 2

| | Material | Process Conditions | | | | | | |
|---|---|---|---|---|---|---|---|---|
| | Tic Particle size (μm) | Type of mold | Cr adding method | Preparatory Cu addition | Atmosphere for infiltration | Vacuum (Pa) | Carbonaceous material | Isolating powder |
| Comparative example 1 | 1.3 | Split | Conductive material | Not made | Vacuum | 13 × 10−2 | on the refractory structure and the boat | Alumina |
| Example 1 | 1.3 | Split | Conductive material | Not made | Vacuum | 13 × 10−2 | on the refractory structure and the boat | Alumina |
| Example 2 | 1.3 | Split | Conductive material | Not made | Vacuum | 13 × 10−2 | on the refractory structure and the boat | Alumina |
| Example 3 | 1.3 | Split | Conductive material | Not made | Vacuum | 13 × 10−2 | on the refractory structure and the boat | Alumina |
| Comparative example 2 | 1.3 | Split | Conductive material | Not made | Vacuum | 13 × 10−2 | on the refractory structure and the boat | Alumina |
| Comparative example 3 | 1.3 | Split | Conductive material | Not made | Vacuum | 17 × 10−2 | on the refractory structure and the boat | Alumina |
| Example 4 | 1.3 | Split | Conductive material | Not made | Vacuum | 13 × 10−2 | on the refractory structure and the boat | Alumina |
| Example 5 | 1.3 | Split | Conductive material | Not made | Vacuum | 13 × 10−2 | on the refractory structure and the boat | Alumina |
| Example 6 | 1.3 | Split | Conductive material | Not made | Vacuum | 13 × 10−2 | on the refractory structure and the boat | Alumina |
| Comparative example 4 | 1.3 | Split | Conductive material | Not made | Vacuum | 13 × 10−2 | on the refractory structure and the boat | Alumina |
| Example 7 | 0.8 | Split | Conductive material | Not made | Vacuum | 13 × 10−2 | on the refractory structure and the boat | Alumina |
| Example 8 | 3.5 | Split | Conductive material | Not made | Vacuum | 13 × 10−2 | on the refractory structure and the boat | Alumina |
| Example 9 | 7.8 | Split | Conductive material | Not made | Vacuum | 13 × 10−2 | on the refractory structure and the boat | Alumina |
| Comparative example 5 | 10.0 | Split | Conductive material | Not made | Vacuum | 13 × 10−2 | on the refractory structure and the boat | Alumina |
| Comparative example 6 | 1.3 | Split | Conductive material | Not made | Vacuum | 13 × 10−2 | on the refractory structure and the boat | Alumina |
| Example 10 | 1.3 | Split | Conductive material | Not made | Vacuum | 13 × 10−2 | on the refractory structure and the boat | Alumina |
| Example 11 | 1.3 | Split | Conductive material | Not made | Vacuum | 13 × 10−2 | on the refractory structure and the boat | Alumina |
| Example 12 | 1.3 | Split | Conductive material | Not made | Vacuum | 13 × 10−2 | on the refractory structure and the boat | Alumina |
| Comparative example 7 | 1.3 | Split | Conductive material | Not made | Vacuum | 13 × 10−2 | on the refractory structure and the boat | Alumina |
| Comparative example 8 | 1.3 | Split | Skeleton | Not made | Vacuum | 13 × 10−2 | on the refractory structure and the boat | Alumina |
| Example 13 | 1.3 | Split | Skeleton | Not made | Vacuum | 13 × 10−2 | on the refractory structure and the boat | Alumina |
| Example 14 | 1.3 | Split | Skeleton | Not made | Vacuum | 13 × 10−2 | on the refractory structure and the boat | Alumina |
| Example 15 | 1.3 | Split | Skeleton | Not made | Vacuum | 13 × 10−2 | on the refractory structure and the boat | Alumina |
| Comparative example 9 | 1.3 | Split | Skeleton | Not made | Vacuum | 13 × 10−2 | on the refractory structure and the boat | Alumina |
| Comparative example 10 | 1.3 | Split | Conductive material | Made | Vacuum | 13 × 10−2 | on the refractory structure and the boat | Alumina |
| Example 16 | 1.3 | Split | Conductive material | Made | Vacuum | 13 × 10−2 | on the refractory structure and the boat | Alumina |
| Example 17 | 1.3 | Split | Conductive material | Made | Vacuum | 13 × 10−2 | on the refractory structure and the boat | Alumina |
| Example 18 | 1.3 | Split | Conductive material | Made | Vacuum | 13 × 10−2 | on the refractory structure and the boat | Alumina |
| Comparative example 11 | 1.3 | Split | Conductive material | Made | Vacuum | 13 × 10−2 | on the refractory structure and the boat | Alumina |
| Comparative example 12 | 1.3 | Split | Conductive material | Not made | Hydrogen | | on the refractory structure and the boat | Alumina |
| Example 19 | 1.3 | Split | Conductive material | Not made | Vacuum | 13 × 10−2 | on the refractory structure and the boat | Alumina |
| Comparative example 13 | 1.3 | Split | Conductive material | Not made | Hydrogen | | Refractory structure and the boat | Alumina |
| Example 20 | 1.3 | Split | Conductive material | Not made | Hydrogen | | None (alumina furnace and alumina boat) | None |
| Comparative example 14 | 1.3 | Split | Conductive material | Not made | Vacuum | 13 × 10−2 | On the refractory structure and the boat | Alumina |
| Example 21 | 1.3 | Split | Conductive material | Not made | Vacuum | 13 × 10−2 | On the refractory structure and the boat | Alumina |
| Comparative example 15 | 1.3 | Extrusion mold | Conductive material | Not made | Vacuum | 13 × 10−2 | On the refractory structure and the boat | Alumina |

TABLE 2-continued

| | Material | Process Conditions | | | | | | |
|---|---|---|---|---|---|---|---|---|
| | Tic Particle size (μm) | Type of mold | Cr adding method | Preparatory Cu addition | Atmosphere for infiltration | Vacuum (Pa) | Carbonaceous material | Isolating powder |
| Example 22 | 1.3 | Split | Conductive material | Not made | Vacuum | 13 × 10−2 | On the refractory structure and the boat | Alumina |

TABLE 3

| | Composition (% wt.) | | | | | |
|---|---|---|---|---|---|---|
| | Cu | Tic | Cr | Cr/ (Cu + Cr) | Cu + Cr | Hydrogen content (ppm) |
| Comparative example 1 | 46.2 | 53.3 | 0.48 | 1.02 | 46.7 | 1.0 |
| Example 1 | 49.3 | 50.2 | 0.48 | 0.96 | 49.8 | 1.0 |
| Example 2 | 62.7 | 36.7 | 0.65 | 1.03 | 63.3 | 1.0 |
| Example 3 | 69.2 | 30.1 | 0.71 | 1.01 | 69.9 | 1.0 |
| Comparative example 2 | 75.1 | 24.2 | 0.74 | 0.98 | 75.8 | 1.0 |
| Comparative example 3 | 60.9 | 38.5 | 0.62 | 1.01 | 61.5 | 0.1 |
| Example 4 | 60.7 | 38.7 | 0.61 | 0.99 | 61.3 | 0.2 |
| Example 5 | 60.4 | 39.0 | 0.63 | 1.03 | 61.0 | 2 |
| Example 6 | 60.6 | 38.8 | 0.62 | 1.02 | 61.2 | 50 |
| Comparative example 4 | 60.1 | 39.3 | 0.59 | 0.97 | 60.7 | 70 |
| Example 7 | 60.3 | 39.1 | 0.62 | 1.02 | 60.9 | 1.0 |
| Example 8 | 60.6 | 38.8 | 0.62 | 1.01 | 61.2 | 1.0 |
| Example 9 | 60.3 | 39.1 | 0.61 | 1.00 | 60.9 | 1.0 |
| Comparative example 5 | 60.2 | 39.2 | 0.60 | 0.99 | 60.8 | 1.0 |
| Comparative example 6 | 61.3 | 38.6 | 0.09 | 0.15 | 61.4 | 1.0 |
| Example 10 | 61.1 | 38.8 | 0.13 | 0.22 | 61.2 | 1.0 |
| Example 11 | 60.0 | 39.3 | 0.67 | 1.10 | 60.7 | 1.0 |
| Example 12 | 59.7 | 39.1 | 1.16 | 1.90 | 60.9 | 1.0 |
| Comparative example 7 | 59.2 | 39.0 | 1.77 | 2.90 | 61.0 | 1.0 |
| Comparative example 8 | 61.1 | 38.9 | 0.08 | 0.13 | 61.1 | 1.0 |
| Example 13 | 60.9 | 39.1 | 0.13 | 0.22 | 60.9 | 1.0 |
| Example 14 | 61.0 | 39.0 | 0.53 | 0.87 | 61.0 | 1.0 |
| Example 15 | 61.7 | 38.3 | 1.23 | 1.95 | 61.7 | 1.0 |
| Comparative example 9 | 62.0 | 38.0 | 1.89 | 2.95 | 62.0 | 1.0 |
| Comparative example 10 | | | | | | |
| Example 16 | 61.8 | 37.6 | 0.62 | 0.99 | 62.4 | 1.0 |
| Example 17 | 60.3 | 39.1 | 0.61 | 1.01 | 60.9 | 1.0 |
| Example 18 | 60.5 | 38.8 | 0.63 | 1.03 | 61.2 | 1.0 |
| Comparative example 11 | 61.4 | 38.0 | 0.62 | 1.00 | 62.0 | 1.0 |
| Comparative example 12 | | | | | | |
| Example 19 | 60.0 | 39.4 | 0.59 | 0.98 | 60.6 | 1.0 |
| Comparative example 13 | | | | | | |
| Example 20 | 60.1 | 39.2 | 0.63 | 1.03 | 60.8 | 1.0 |
| Comparative example 14 | | | | | | |
| Example 21 | 60.9 | 38.4 | 0.62 | 1.01 | 61.6 | 1.0 |
| Comparative example 15 | | | | | | |
| Example 22 | 61.1 | 38.3 | 0.61 | 0.99 | 61.7 | 1.0 |

TABLE 4

| | Electrical characteristics | | |
|---|---|---|---|
| | Interrupting ability | Chopping current | Current carrying |
| Comparative example 1 | Rejectable | 1.5 | 1.4 |
| Example 1 | Acceptable | 0.9 | 1.1 |
| Example 2 | Acceptable | 1.0 | 1.0 |
| Example 3 | Acceptable | 1.0 | 0.9 |
| Comparative example 2 | Acceptable | 2.2 | 0.7 |
| Comparative example 3 | Acceptable | 2.2 | 1.0 |
| Example 4 | Acceptable | 1.1 | 1.0 |
| Example 5 | Acceptable | 1.0 | 1.0 |
| Example 6 | Acceptable | 1.0 | 1.0 |
| Comparative example 4 | Rejectable | 1.0 | 1.0 |
| Example 7 | Acceptable | 1.2 | 1.0 |
| Example 8 | Acceptable | 1.1 | 1.0 |
| Example 9 | Acceptable | 1.0 | 1.0 |
| Comparative example 5 | Rejectable | 1.0 | 1.0 |
| Comparative example 6 | Acceptable | 1.1 | 2.2 |
| Example 10 | Acceptable | 1.1 | 0.9 |
| Example 11 | Acceptable | 1.0 | 1.0 |
| Example 12 | Acceptable | 1.0 | 1.9 |
| Comparative example 7 | Rejectable | 0.8 | 4.0 |
| Comparative example 8 | Acceptable | 1.1 | 3.0 |
| Example 13 | Acceptable | 1.2 | 0.7 |
| Example 14 | Acceptable | 1.0 | 0.8 |
| Example 15 | Acceptable | 1.0 | 1.3 |
| Comparative example 9 | Rejectable | 0.8 | 2.5 |
| Comparative example 10 | | | |
| Example 16 | Acceptable | 0.9 | 1.1 |
| Example 17 | Acceptable | 1.0 | 1.0 |
| Example 18 | Acceptable | 1.8 | 0.8 |
| Comparative example 11 | Acceptable | 2.2 | 0.7 |
| Comparative example 12 | | | |
| Example 19 | Acceptable | 1.0 | 1.0 |
| Comparative example 13 | | | |
| Example 20 | Acceptable | 1.0 | 1.0 |
| Comparative example 14 | | | |
| Example 21 | Acceptable | 1.0 | 1.0 |
| Comparative example 15 | | | |
| Example 22 | Acceptable | 1.0 | 1.0 |

Second Embodiment

A second embodiment of the present invention will be described on the basis of experimental results.

Method of Making Samples

A contact manufacturing method includes, as "basic processes":

a mixing process for preparing a mixture of 84 parts vol. of TiC powder having a mean particle diameter of 1.5 μm, 16 parts vol. of Cu powder having a mean particle diameter of 40 μm and 15% by volume of a paraffin;

a molding process for molding the mixture in a compression mold of 1.1 in the ratio of the diameter of an opening on an extracting side to that of an opening on the opposite side by applying a pressure of 4 tons to the mixture to form a molding; a deparaffinizing process for heating the molding at 300° C. for 2 hr in a nitrogen atmosphere; and an infiltration process for infiltrating the deparaffinized molding with a volume of Cu equal a 0.05 times that of pores formed in the molding by heating the molding at 1150° C. for 30 min in a vacuum.

The foregoing processes (i.e., the above-mentioned contact manufacturing method) are referred to as "basic processes" hereinafter.

The molding may be heated in the infiltration process at a temperature in the range of 1100 to 1200° C. instead of 1150° C. In Tables 5 to 7, each of values indicating the amounts of infiltrating materials is the ratio $V_a/V_b$, where $V_a$ is the volume of the infiltrating material and $V_b$ is the volume of the pores of the molding.

Figure 3:
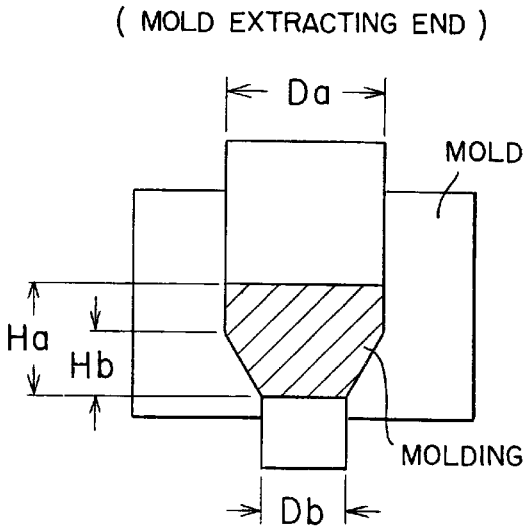
FIG. 3 is a sectional view of a mold for molding a contact for a vacuum interrupter according to the present invention.

As shown in FIG. 3, the mold employed in the molding process has a cavity having a diameter ratio $D_a/D_b=1.1$, where $D_a$ is the diameter of an molding extracting end of the cavity and $D_b$ is the diameter of an end of the same opposite the mold extracting end, and the cavity of the mold corresponding to the molding to be molded therein has a height $H_a$ and a part of the cavity, having a height $H_b$ equal to 80 to 100% of the height $H_a$ of the cavity is tapered.

Note that, in the description of second embodiment, the numerical values expressed in "% by volume" and "vol %" were obtained by calculation based on the weights and specific gravities (densities) of the respective components contained in the alloy or the mixture. Volumes of the respective components were not measured.

Evaluation of Sample Contacts

Method of evaluating sample contacts in examples of the present invention and comparative examples will be described.

Contacts were made under different process conditions determined by selectively determining the process parameters of the foregoing basic processes. The composition of materials forming the contacts in which any cracks were not formed was analyzed, the conductivity and the gas content of the same contacts were measured, and the interruption ability and chopping current characteristics of the same contacts were evaluated. The moldings formed of materials containing a paraffin and processed by the deparaffinizing process were subjected to deparaffinization ratio measurement. The sample contacts were subjected to the following tests to evaluate their interruption ability, chopping current characteristics and conductivity.

(1) Chopping Current Characteristic Test

A knockdown vacuum interrupter provided with the sample alloy contacts was built and was evacuated to a vacuum of $10^{-5}$ Pa or higher. The contacts of the vacuum interrupter were parted at a contact parting speed of 0.8 m/s to break a small current and a chopping current was measured. The interruption current was 20 A (effective value) and 50 Hz. The contact parting operation was executed at random phases by 500 cycles. Three pairs of contacts of the same type were tested. Measured results are tabulated in Tables 8 to 10. Values shown in Tables 8 to 10 are relative values obtained by normalizing measured values by a threshold chopping current serving as a criterion on which the decision of acceptance is based.

(2) Current Carrying Characteristic Test

The conductivity of the contacts was measured by a conductivity meter of an eddy-current measurement system.

(3) Large Current Interruption Ability Test

Circuit breaking tests were carried out according to Test Method No. 5 specified in JEC Standards. The results of the tests (1) to (3) are tabulated in Tables 8 to 10.

Values of the process parameters of the processes for making the contacts and the condition of the contact in terms of cracks are tabulated in Tables 5 to 7. Results of evaluation of the characteristics are tabulated in Tables 8 to 10.

Results of Experiments

The composition of the materials forming the contacts and the characteristics of the contacts will be examined with reference to Tables 5 to 10.

Re: Examples 1 to 6 and Comparative Examples 1 to 9

Contacts in Examples 1 to 6 and Comparative examples 1 to 9 were made by processing mixtures respectively having different Cu contents in the range of 16 to 43% by volume, and different paraffin contents in the range of 0 to 50% by volume. As shown in Tables 5 and 8. The other test conditions are the same as that of the basic processes.

Note that, paraffin contents are calculated as follows:

(paraffin/the sum of TiC powder, Cu powder and paraffin)

Moldings for Comparative examples 1, 4 and 7 formed of the mixtures not containing any paraffin and moldings for Comparative examples 2, 5 and 8 formed of mixtures having a paraffin content of 3% by volume were cracked. Moldings for Examples 1 to 6 respectively having different paraffin contents in the range of 5 to 30% by volume were not cracked at all. Contacts in Examples 1 to 6 were satisfactory in interruption ability and current carrying ability.

The contacts in Comparative examples 3, 6 and 9 formed by processing the mixtures having a paraffin content of 50% by volume had Cu contents exceeding 55% by volume and had unsatisfactory chopping current characteristics. The Cu content of a contact formed by processing a molding of a mixture having an excessively large paraffin content becomes inevitably large because spaces formed in the molding by deparaffinization are filled up with Cu when the molding is subjected to infiltration.

Re: Examples 7 and 8 and Comparative Examples 10 and 11

Mixtures for Examples 7 and 8 and Comparative examples 10 and 11 contain TiC of different particle sizes in the range of 0.2 to 5 μm as shown in Tables 5 and 8. The other test conditions are the same as that of the basic processes.

A molding for Comparative example 10 formed by processing a mixture containing TiC of a particle size of 0.2 μm was cracked.

Moldings for Examples 7 and 8 formed by processing mixtures containing TiC of different particle sizes in the range of 0.3 to 3 μm were not cracked at all. Contacts in Examples 7 and 8 were satisfactory in conductivity, interruption ability and current carrying ability.

The contact in Comparative example 11 formed by processing a mixture containing TiC of a particle size of 5 μm was not satisfactory in interruption ability.

Re: Examples 9 and 10 and Comparative Example 12

Mixtures for Examples 9 and 10 and Comparative example 12 contain Cu of different particle sizes in the range of 5 to 150 μm as shown in Tables 5 and 8. The other test conditions are the same as that of the basic processes.

A molding for Comparative example 12 formed by processing a mixture containing Cu of a particle size of 150 μm was cracked.

Moldings for Examples 9 and 10 formed by processing mixtures containing Cu of particle sizes not greater than 100

μm were not cracked at all. Contacts in Examples 9 and 10 were satisfactory in conductivity, interruption ability and current carrying ability.

Re: Examples 11 and 12 and Comparative Example s 13 to 18

Moldings for Examples 11 and 12 and Comparative examples 13 to 18 were subjected to deparaffinizing processes respectively using a nitrogen atmosphere, a hydrogen atmosphere and different process temperatures in the range of 200 to 600° C., respectively. The other test conditions are the same as that of the basic processes.

The paraffin could not completely be removed from moldings for Comparative examples 13 and 15 processed at 200° C. for deparaffinization, and the processes following the deparaffinizing process could not be carried out.

Moldings for Examples 11 and 12 processed at temperatures in the range of 300 to 500° C. in a nitrogen atmosphere were deparaffinized satisfactorily and contacts in Examples 11 and 12 were satisfactory in breaking characteristic, chopping current characteristics and current carrying characteristics.

A contact in Comparative example 14 formed by processing a molding deparaffinized at 600° C. in a nitrogen atmosphere had an excessively large oxygen content and was unsatisfactory in breaking characteristic, which was considered that oxygen contained in nitrogen caused oxidation.

Contacts in Comparative examples 16 to 18 formed by processing moldings deparaffinized in a hydrogen atmosphere had excessively large hydrogen contents and were unsatisfactory in breaking characteristic.

Re: Examples 13 to 16 and Comparative Examples 19 to 20

Moldings were deparaffinized in a hydrogen atmosphere and were subjected to a dehydrogenating process at temperatures in the range of 800 to 1000° C. for 0.2 to 1.0 hr in a vacuum as shown in Tables 6 and 9 after being processed by the deparaffinizing process. The other test conditions are the same as that of the basic processes.

Hydrogen could not completely be removed from a molding for Comparative example 20 dehydrogenated at 1000° C. for 0.2 hr and the breaking characteristic of a contact in Comparative example 20 was rejectable. Contacts in Examples 13 to 16 formed by processing moldings dehydrogenated at temperatures not lower than 900° C. for 0.5 hr or longer had sufficiently low hydrogen contents and were satisfactory in interruption ability, chopping current characteristics and current carrying characteristics.

Re: Examples 17 and 18 and Comparative Examples 21 and 22

Moldings were subjected to the deparaffinizing process at temperatures in the range of 200 to 1100° C. in a hydrogen atmosphere, and then were subjected to a dehydrogenating process at 1000° C. for 1.0 hr in a vacuum as shown in Tables 6 and 9. The other test conditions are the same as that of the basic processes.

A molding for Comparative example 21 deparaffinized at 200° C. was not deparaffinized satisfactorily and the molding could not be subjected to the following processes.

Contacts in Examples 17 and 18 formed by processing moldings deparaffinized at temperatures not lower than 300° C. and not higher than 1083° C. corresponding to the melting point of the conductive component had sufficiently small hydrogen contents and were satisfactory in interruption ability, chopping current characteristics and current carrying ability.

Hydrogen could not satisfactorily be removed from a molding for Comparative example 21 deparaffinized at 1100° C. and a contact formed by processing the same molding was unsatisfactory in interruption ability, which is attributable to the combination of hydrogen contained in the melted paraffin with the conductive component due to the excessively high deparaffinizing temperature exceeding the melting point of the conductive component.

Re: Examples 19 to 22 and Comparative Examples 23 and 24

The deparaffinizing process was executed at temperatures in the range of 30 to 68° C. for Examples 19 to 22 and Comparative examples 23 and 24 in an atmosphere of n-hexane. N-hexane was changed once or twice when the paraffin concentration of n-hexane increased excessively as shown in Tables 6 and 9. The other test conditions are the same as that of the basic processes.

A molding for Comparative example 23 deparaffinized by using n-hexane heated at 30° C. and changing n-hexane once and a molding for Comparative example 24 deparaffinized by using n-hexane heated at 68° C. and n-hexane was not changed were not deparaffinized satisfactorily, and the moldings could not be subjected to the following processes. Moldings for Examples 19 to 22 deparaffinized by using n-hexane heated at temperatures in the range of 40 to 68° C. and n-hexane was changed at least once were deparaffinized satisfactorily and formed contacts satisfactory in interruption ability, chopping current characteristics and current carrying ability.

Re: Examples 23 to 30 and Comparative Examples 25 to 28

Small amounts of sintering additives Co, Fe, Ni and Cr were added to the mixture of TiC and Cu, moldings were deparaffinized, and the moldings were sintered at 1150° C. for 2 hr in a vacuum to form skeletons (Tables 7 and 10). The other test conditions are the same as that of the basic processes.

Note that, sintering additives contents are calculated as follows:

(sintering additives/the sum of TiC powder, Cu powder, paraffin and sintering additives)

The contacts in Comparative examples 25 to 28 respectively having Co contents greater than 0.1% by weight, Fe contents greater than 0.1% by weight, Ni contents greater than 0.3% by weight and Cr contents greater than 3% by weight had low conductivities not higher than 20 IACS percent.

The contacts in Examples 23 to 30 having Co contents not greater than 0.1% by weight, Fe contents not greater than 0.1% by weight, Ni contents not greater than 0.3% by weight and Cr contents not greater than 3% by weight were satisfactory in interruption ability, chopping current characteristics and current carrying ability.

Re: Examples 31 and 32 and Comparative Examples 29 and 30

In the infiltration process, skeletons for Examples 31 and 32 and Comparative examples 29 and 30 were infiltrated with amounts of infiltrating material in the range of 90 to 120% of the volume of pores of the skeletons, respectively (Tables 7 and 10). The other test conditions are the same as that of the basic processes.

The skeleton for Comparative example 29 infiltrated with an amount of the infiltrating material equal to 90% of the volume of the pores thereof had an excessively large volume of pores and a contact in Comparative example 29 had a very large oxygen content, a low conductivity and a bad interruption characteristics.

Skeletons for Examples 31 and 22 containing amounts of infiltrating material equal to 100 to 110% of the volume of pores had small volumes of pores, and were not cracked. Contacts in Examples 31 and 32 were satisfactory in interruption ability, chopping current characteristics and current carrying ability.

A contact in Comparative example 30 containing an amount of infiltrating material equal to 120% of the volume of pores had internal cracks. It is inferred that the cracks were formed when the excessive infiltrating material solidifies and shrinks.

Re: Examples 33 to 35 and Comparative Example 31

Moldings for Examples 33 to 35 and Comparative example 31 were formed by molding mixtures not containing any paraffin by using compression molds having $D_a/D_b$ ratios in the range of 1.0 to 2.0 (Tables 7 and 10). The other test conditions are the same as that of the basic processes.

A molding for Comparative example 31 formed by using the compression molding having the having a $D_a/D_b$ ratio of 1.0 was cracked and could not be molded. Moldings for Examples 33 to 35 formed by using molds having a $D_a/D_b$ ratios not smaller than 1.1 were not cracked. Contacts in Examples 33 to 35 were satisfactory in interruption ability, chopping current characteristics and current carrying ability.

Although the Cu—TiC contacts have been described, the contact manufacturing method of the present invention can effectively be applied also to manufacturing Cu—VC contacts.

Furthermore, although Cu is used as a conductive material in the above-mentioned embodiment, a Cu based alloy including other conductive component(s) such as Zr or Cr may be used as a conductive material.

It is obvious to those skilled in the art that the deparaffinizing process can satisfactorily be achieved by using a hydrocarbon cleaning agent having a boiling point of 50° C. or above, such as a petroleum naphtha, a petroleum naphthene or a mixture of those hydrocarbons instead of n-hexane.

TABLE 5

| | Materials Particle size (μm) | | Mixing Process Content (% by vol.) | | Paraffin Content | Additive sintering material | | Molding process | | Deparaffinizing process Paraffin extracting medium | | | | Dehydrogenating process | | Infiltration process Infiltrating | |
|---|---|---|---|---|---|---|---|---|---|---|---|---|---|---|---|---|---|
| | Tic | Cu | Tic | Cu | (% vol.) | Material | (% wt.) | Diameter ratio | Molding pressure (ton) | (Atmosphere) | Temperature (° C.) | Time (hr) | Cycles | Temperature (° C.) | Time | material | Cracking |
| Comparative Example 1 | 1.5 | 40 | 84 | 16 | 0 | | | 1.1 | 4 | | | | | | | 1.05 | Cracked |
| Comparative Example 2 | | | | | 3 | | | | | $N_2$ | 300 | 2 | 1 | | | | Cracked |
| Example 1 | | | | | 5 | | | | | | | | | | | | Not cracked |
| Example 2 | | | | | 30 | | | | | | | | | | | | Not cracked |
| Comparative Example 3 | | | | | 50 | | | | | | | | | | | | Not cracked |
| Comparative Example 4 | | | 70 | 30 | 0 | | | | | | | | | | | | Cracked |
| Comparative Example 5 | | | | | 3 | | | | | $N_2$ | 300 | 2 | 1 | | | | Cracked |
| Example 3 | | | | | 5 | | | | | | | | | | | | Not cracked |
| Example 4 | | | | | 30 | | | | | | | | | | | | Not cracked |
| Comparative Example 6 | | | | | 50 | | | | | | | | | | | | Not cracked |
| Comparative Example 7 | | | 57 | 43 | 0 | | | | | | | | | | | | Cracked |
| Comparative Example 8 | | | | | 3 | | | | | $N_2$ | 300 | 2 | 1 | | | | Cracked |
| Example 5 | | | | | 5 | | | | | | | | | | | | Not cracked |
| Example 6 | | | | | 30 | | | | | | | | | | | | Not cracked |
| Comparative Example 9 | | | | | 50 | | | | | | | | | | | | Not cracked |
| Comparative Example 10 | 0.2 | 40 | 84 | 16 | 15 | | | 1.1 | 4 | $N_2$ | 300 | 2 | 1 | | | 1.05 | Cracked |
| Example 7 | 0.3 | | | | | | | | | | | | | | | | Not cracked |
| Example 8 | 3.0 | | | | | | | | | | | | | | | | Not cracked |
| Comparative Example 11 | 5.0 | | | | | | | | | | | | | | | | Not cracked |
| Example 9 | 1.5 | 5 | 84 | 16 | 15 | | | 1.1 | 4 | $N_2$ | 300 | 2 | 1 | | | 1.05 | Not cracked |
| Example 10 | | 100 | | | | | | | | | | | | | | | Not cracked |
| Comparative Example 12 | | 150 | | | | | | | | | | | | | | | cracked |

TABLE 6

| | Materials Particle size (μm) | | Mixing Process: Content (% by vol.) | | Mixing Process: Paraffin Content | Mixing Process: Additive sintering material | | Molding process | | Deparaffinizing process: Paraffin extracting medium | | | | Dehydrogenating process | | Infiltration process | |
|---|---|---|---|---|---|---|---|---|---|---|---|---|---|---|---|---|---|
| | Tic | Cu | Tic | Cu | (% vol.) | Material | (% wt.) | Diameter ratio | Molding pressure (ton) | (Atmosphere) | Temperature (° C.) | Time (hr) | Cycles | Temperature (° C.) | Time | Infiltrating material | Cracking |
| Comparative Example 13 | 1.5 | 40 | 84 | 16 | 15 | | | 1.1 | 4 | $N_2$ | 200 | 2 | 1 | | | 1.05 | Not cracked |
| Example 11 | | | | | | | | | | | 300 | | | | | | Not cracked |
| Example 12 | | | | | | | | | | | 600 | | | | | | Not cracked |
| Comparative Example 14 | | | | | | | | | | | 600 | | | | | | Not cracked |
| Comparative Example 15 | | | | | | | | | | $H_2$ | 200 | 2 | 1 | | | | Not cracked |
| Comparative Example 16 | | | | | | | | | | | 300 | | | | | | cracked |
| Comparative Example 17 | | | | | | | | | | | 600 | | | | | | Not cracked |
| Comparative Example 18 | | | | | | | | | | | 600 | | | | | | Not cracked |
| Comparative Example 19 | 1.5 | 40 | 84 | 16 | 15 | | | 1.1 | 4 | $H_2$ | 300 | 2 | 1 | 800 | 1.0 | 1.05 | Not cracked |
| Example 13 | | | | | | | | | | | | | | 900 | | | Not cracked |
| Example 14 | | | | | | | | | | | | | | 1000 | | | Not cracked |
| Comparative Example 20 | | | | | | | | | | | | | | 1000 | 0.2 | | Not cracked |
| Example 15 | | | | | | | | | | | | | | | 0.5 | | Not cracked |
| Example 16 | | | | | | | | | | | | | | | 1.0 | | Not cracked |
| Comparative Example 21 | 1.5 | 40 | 84 | 16 | 15 | | | 1.1 | 4 | $H_2$ | 200 | 2 | 1 | 1000 | 1.0 | 1.05 | Not cracked |
| Example 17 | | | | | | | | | | | 300 | | | | | | Not cracked |
| Example 18 | | | | | | | | | | | 1050 | | | | | | Not cracked |
| Comparative Example 22 | | | | | | | | | | | 1100 | | | | | | Not cracked |
| Comparative Example 23 | 1.5 | 40 | 84 | 16 | 15 | | | 1.1 | 4 | n-hexane | 30 | 2 | 2 | | | 1.05 | Not cracked |
| Example 19 | | | | | | | | | | | 40 | | | | | | Not cracked |

TABLE 6-continued

| | Mixing Process | | | | | | | | | Deparaffinizing process | | | | | | | | |
|---|---|---|---|---|---|---|---|---|---|---|---|---|---|---|---|---|---|---|
| | Materials Particle size (μm) | | Content (% by vol.) | | Paraffin Content | Additive sintering material | | Molding process | | Paraffin extracting medium | Temperature | Time | | Dehydrogenating process | | Infiltration process Infiltrating | |
| | Tic | Cu | Tic | Cu | (% vol.) | Material | Content (% wt.) | Diameter ratio | Molding pressure (ton) | (Atmosphere) | (° C.) | (hr) | Cycles | Temperature (° C.) | Time | material | Cracking |
| Example 20 | | | | | | | | | | | 68 | | | | | | Not cracked |
| Comparative Example 24 | | | | | | | | | | | 68 | | 1 | | | | Not cracked |
| Example 21 | | | | | | | | | | | | | 2 | | | | Not cracked |
| Example 22 | | | | | | | | | | | | | 3 | | | | Not cracked |

TABLE 6

| | Mixing Process | | | | | | | | | Deparaffinizing process | | | | | | | |
|---|---|---|---|---|---|---|---|---|---|---|---|---|---|---|---|---|---|
| | Materials Particle size (μm) | | Content (% by vol.) | | Paraffin Content | Additive sintering material | | Molding process | | Paraffin extracting medium | | | | Dehydrogenating process | | Infiltration process | |
| | Tic | Cu | Tic | Cu | (% vol.) | Material | Content (% wt.) | Diameter ratio | Molding pressure (ton) | (Atmosphere) | Temperature (° C.) | Time (hr) | Cycles | Temperature (° C.) | Time | Infiltrating material | Cracking |
| Example 13 | 1.5 | 40 | 84 | 16 | 15 | Co | 0.05 | 1.1 | 4 | $N_2$ | 300 | 2 | 1 | | | 1.05 | Not cracked |
| Example 24 | | | | | | | 0.1 | | | | | | | | | | Not cracked |
| Comparative Example 25 | | | | | | | 0.3 | | | | | | | | | | Not cracked |
| Example 25 | | | | | | Fe | 0.05 | | | | | | | | | | Not cracked |
| Example 26 | | | | | | | 0.1 | | | | | | | | | | Not cracked |
| Comparative Example 26 | | | | | | | 0.3 | | | | | | | | | | Not cracked |
| Example 27 | | | | | | Ni | 0.1 | | | | | | | | | | Not cracked |
| Example 28 | | | | | | | 0.3 | | | | | | | | | | Not cracked |
| Comparative Example 27 | | | | | | | 0.5 | | | | | | | | | | Not cracked |
| Example 29 | | | | | | Cr | 1 | | | | | | | | | | Not cracked |
| Example 30 | | | | | | | 3 | | | | | | | | | | Not cracked |
| Comparative Example 28 | | | | | | | 5 | | | | | | | | | | Not cracked |
| Comparative Example 29 | 1.5 | 40 | 84 | 16 | 15 | | | 1.1 | 4 | $N_2$ | 300 | 2 | 1 | | | 0.90 | Not cracked |
| Example 31 | | | | | | | | | | | | | | | | 1.00 | Not cracked |
| Example 32 | | | | | | | | | | | | | | | | 1.10 | Not cracked |
| Comparative Example 30 | | | | | | | | | | | | | | | | 1.20 | Cracked |
| Comparative Example 31 | 1.5 | 40 | 84 | 16 | | | | 1.0 | 4 | $N_2$ | 300 | 2 | 1 | | | 1.05 | Cracked |
| Example 33 | | | | | | | | 1.1 | | | | | | | | | Not cracked |
| Example 34 | | | | | | | | 1.5 | | | | | | | | | Not cracked |
| Example 35 | | | | | | | | 2.0 | | | | | | | | | Not cracked |

TABLE 8

| | Composition (% vol.) | | | | Material characteristics | | | | Electrical characteristics | |
|---|---|---|---|---|---|---|---|---|---|---|
| | | | Additive components | | Residual paraffin | Gas content (ppm) | | Conductivity | Chopping | Interrupting |
| | Cu | Tic | Material | Amount | (%) | $H_2$ | $O_2$ | (IACS %) | current | ability |
| Comparative Example 1 | | | | | | | | | | |
| Comparative Example 2 | | | | | | | | | | |
| Example 1 | 46.3 | 53.7 | | | 0 | 15 | 30 | 26.2 | 1.0 | Accaptable |
| Example 2 | 49.7 | 50.3 | | | 0 | 20 | 30 | 30.8 | 1.3 | Acceptable |
| Comparative Example 3 | 56.2 | 43.8 | | | 0 | 25 | 25 | 38.0 | 2.5 | Acceptable |
| Comparative Example 4 | | | | | | | | | | |
| Comparative Example 5 | | | | | | | | | | |
| Example 3 | 51.4 | 48.6 | | | 0 | 30 | 25 | 30.3 | 1.2 | Acceptable |
| Example 4 | 53.8 | 46.2 | | | 0 | 25 | 30 | 31.5 | 1.5 | Acceptable |
| Comparative Example 6 | 58.5 | 41.5 | | | 0 | 30 | 15 | 37.2 | 2.5 | Acceptable |
| Comparative Example 7 | | | | | | | | | | |
| Comparative Example 8 | | | | | | | | | | |
| Example 5 | 54.0 | 46.0 | | | 0 | 30 | 15 | 36.2 | 1.7 | Acceptable |
| Example 6 | 54.9 | 45.1 | | | 0 | 15 | 30 | 36.7 | 1.7 | Acceptable |
| Comparative Example 9 | 60.9 | 39.1 | | | 0 | 20 | 25 | 39.5 | 3.0 | Acceptable |
| Comparative Example 10 | | | | | | | | | | |
| Example 7 | 49.3 | 50.7 | | | 0 | 25 | 30 | 30.0 | 1.2 | Acceptable |
| Example 8 | 40.5 | 59.5 | | | 0 | 25 | 25 | 23.1 | 0.8 | Acceptable |
| Comparative Example 11 | 40.3 | 59.7 | | | 15 | 25 | 22.9 | 0.8 | Rejectable | |
| Example 9 | 40.2 | 59.8 | | | c | 30 | 20 | 23.5 | 0.8 | Acceptable |
| Example 10 | 54.9 | 45.1 | | | 0 | 30 | 20 | 36.1 | 1.7 | Acceptable |
| Comparative Example 12 | 58.3 | 41.7 | | | 0 | 35 | 20 | 38.0 | 2.3 | Acceptable |

TABLE 8

| | Composition (% vol.) | | | | Material characteristics | | | | Electrical characteristics | |
|---|---|---|---|---|---|---|---|---|---|---|
| | | | Additive components | | Residual paraffin | Gas content (ppm) | | Conductivity | Chopping | Interrupting |
| | Cu | Tic | Material | Amount | (%) | $H_2$ | $O_2$ | (IACS %) | current | ability |
| Comparative Example 13 | | | | | 20 | | | | | |
| Example 11 | 41.8 | 55.2 | | | 1 | 30 | 300 | 25.7 | 0.9 | Acceptable |
| Example 12 | 46.1 | 53.9 | | | 0 | 30 | 400 | 24.7 | 0.9 | Accaptable |
| Comparative Example 14 | 45.8 | 54.2 | | | 0 | 35 | 1500 | 24.9 | 0.8 | Rejectable |
| Comparative Example 15 | | | | | 20 | | | | | |
| Comparative Example 16 | 45.4 | 54.6 | | | 1 | 120 | 25 | 25.0 | 0.8 | Rejectable |
| Comparative Example 17 | 46.1 | 53.9 | | | 0 | 160 | 30 | 24.8 | 0.8 | Rejectable |
| Comparative Example 18 | 46.0 | 54.0 | | | 0 | 200 | 25 | 25.0 | 0.7 | Rejectable |
| Comparative Example 19 | 45.7 | 54.3 | | | 0 | 100 | 20 | 25.2 | 0.9 | Rejectable |
| Example 13 | 44.8 | 55.2 | | | 0 | 40 | 15 | 24.6 | 1.0 | Acceptable |
| Example 14 | 44.8 | 55.2 | | | 0 | 20 | 25 | 24.9 | 1.0 | Acceptable |
| Comparative Example 20 | 45.0 | 55.0 | | | 0 | 120 | 25 | 24.9 | 0.8 | Rejectable |
| Example 15 | 45.3 | 54.7 | | | 0 | 45 | 15 | 25.0 | 1.0 | Acceptable |
| Example 16 | 44.9 | 55.1 | | | 0 | 20 | 20 | 25.1 | 1.0 | Acceptable |
| Comparative Example 21 | | | | | 20 | | | | | |
| Example 17 | 45.5 | 54.5 | | | 0 | 20 | 25 | 24.8 | 1.0 | Acceptable |
| Example 18 | 46.0 | 54.0 | | | 0 | 10 | 15 | 25.1 | 1.0 | Acceptable |
| Comparative Example 22 | 46.2 | 53.8 | | | 0 | 150 | 10 | 25.1 | 0.8 | |
| Comparative Example 23 | | | | | 25 | | | | | |
| Example 19 | 45.1 | 54.9 | | | 5 | 30 | 35 | 25.2 | 1.0 | Acceptable |
| Example 20 | 45.8 | 54.2 | | | 1 | 25 | 25 | 24.9 | 1.0 | Acceptable |
| Comparative Example 24 | | | | | 17 | | | | | |
| Example 21 | 45.2 | 54.8 | | | 0 | 20 | 20 | 24.6 | 1.0 | Acceptable |
| Example 22 | 45.0 | 55.0 | | | 0 | 15 | 30 | 25.3 | 1.0 | Acceptable |

TABLE 8

| | Composition (% vol.) | | | | Material characteristics | | | | Electrical characteristics | |
|---|---|---|---|---|---|---|---|---|---|---|
| | | | Additive components | | Residual paraffin | Gas content (ppm) | | Conductivity | Chopping | Interrupting |
| | Cu | Tic | Material | Amount | (%) | $H_2$ | $O_2$ | (IACS %) | current | ability |
| Example 23 | 45.0 | 55.0 | Co | 0.03 | 0 | 15 | 20 | 24.9 | 1.1 | Acceptable |
| Example 24 | 45.2 | 54.7 | | 0.06 | 0 | 15 | 25 | 23.5 | 1.1 | Acceptable |
| Comparative Example 25 | 45.4 | 54.4 | | 0.20 | 0 | 20 | 35 | 15.1 | 0.9 | Acceptable |
| Example 25 | 45.3 | 54.7 | Fe | 0.03 | 0 | 25 | 30 | 24.8 | 1.1 | Acceptable |
| Example 26 | 44.9 | 55.0 | | 0.06 | 0 | 20 | 30 | 23.0 | 1.0 | Acceptable |
| Comparative Example 26 | 45.7 | 54.1 | | 0.21 | 0 | 15 | 20 | 15.9 | 0.9 | Acceptable |
| Example 27 | 43.6 | 54.3 | Ni | 0.06 | 0 | 30 | 20 | 25.2 | 1.1 | Acceptable |
| Example 28 | 43.6 | 54.2 | | 0.20 | 0 | 25 | 35 | 23.5 | 1.0 | Acceptable |
| Comparative Example 27 | 44.7 | 55.0 | | 0.32 | 0 | 25 | 20 | 15.1 | 0.9 | Acceptable |
| Example 29 | 45.5 | 53.9 | Cr | 0.62 | 0 | 20 | 15 | 25.3 | 1.1 | Acceptable |
| Example 30 | 43.2 | 53.6 | | 2.20 | 0 | 15 | 25 | 23.1 | 0.9 | Acceptable |
| Comparative Example 28 | 43.8 | 50.9 | | 3.32 | 0 | 20 | 35 | 16.9 | 0.8 | Acceptable |
| Comparative Example 29 | 44.9 | 55.1 | | | 0 | 30 | 1200 | 18.3 | 1.0 | Rejectable |
| Example 31 | 45.0 | 55.0 | | | 0 | 20 | 20 | 24.9 | 1.0 | Acceptable |
| Example 32 | 44.9 | 55.1 | | | 0 | 15 | 25 | 25.3 | 1.0 | Acceptable |
| Comparative Example 30 | | | | | | | | | | |
| Comparative Example 31 | | | | | | | | | | |
| Example 33 | 45.5 | 54.5 | | | 0 | 25 | 30 | 25.2 | 1.0 | Acceptable |
| Example 34 | 45.4 | 54.6 | | | 0 | 20 | 20 | 24.9 | 1.0 | Acceptable |
| Example 35 | 45.1 | 54.9 | | | 0 | 30 | 15 | 25.0 | 1.0 | Acceptable |

What is claimed is:

1. A contact material for contacts for a vacuum interrupter, said material comprising:

(a) 50 to 70% by weight of a conductive material containing Cu as a principal component;

(b) 30 to 50% by weight of at least either TiC or VC having a mean particle diameter of 8 $\mu$m or below and serving as an arc-proof component; and (c)

(i) 0.2 to 2.0% by weight of Cr relative to the sum of the respective amounts of Cr and Cu; or (ii) 0.2 to 2.0% by weight of Zr relative to the sum of the respective amounts of Zr and Cu;

wherein the contact material has a hydrogen content in the range of 0.2 to 50 ppm.

2. A method of manufacturing a contact for a vacuum interrupter, said method comprising the steps of:

forming a skeleton from a powder containing at least a TiC powder or a VC powder as a principal component and having a mean particle diameter of 8 $\mu$m or below; and providing an infiltrating material containing a Cu-base alloy having a Cr content in the range of 0.2 to 2.0% by weight, relative to total weight to the Cu-base alloy, or a Cu-base alloy having a Zr content in the range of 0.2 to 2.0% by weight, relative to total weight to the Cu-base alloy; and infiltrating the skeleton with the infiltrating material;

wherein the contact contains 30 to 70% by weight of the skeleton and 50 to 70% by weight of the infiltrating material, and wherein the infiltrating step is carried out in an evacuated atmosphere of a pressure not higher than $1\times10^{-1}$ Pa.

3. The method according to claim 2, wherein the TiC powder has a mean particle diameter of 8 $\mu$m or below.

4. The method according to claim 2, wherein the powder from which the skeleton is formed has a Cu content in the range of 10 to 40% by weight.

5. The method according to claim 2, wherein the step of infiltrating the skeleton is carried out in a furnace having walls lined with a refractory material containing only an oxide and/or a nitride, and wherein the skeleton is placed in a crucible made of an oxide or a nitride.

6. The method according to claim 2, wherein at least either the refractory material of the furnace or the crucible employed in the step of infiltrating the skeleton is formed of a carbonaceous material, and wherein the infiltrating material and the skeleton are isolated from the carbonaceous material by a plate, a block or power of $Al_2O_3$.

7. The method according to claim 2, wherein the step of forming the skeleton employs a split outer mold.

8. A method of manufacturing a contact for a vacuum interrupter, said method comprising the steps of:

forming a skeleton having a particle size of 8 $\mu$m or below from a powder containing at least TiC or VC as a principal component and containing 0.25 to 2.3% by weight of Cr or Zr, relative to total weight of the skeleton; and infiltrating the skeleton with an infiltrating material containing Cu as a principal component;

wherein the contact comprises 30 to 70% by weight of the skeleton and 50 to 70% by weight of the infiltrating material, and wherein the infiltrating step is carried out in an evacuated atmosphere of a pressure not higher than $1\times10^{-1}$ Pa.

9. The method according to claim 8, wherein the TiC powder has a mean particle diameter of 8 $\mu$m or below.

10. The method according to claim 8, wherein the powder from which the skeleton is formed has a Cu content in the range of 10 to 40% by weight.

11. The method according to claim 8, wherein the step of infiltrating the skeleton is carried out in a furnace having walls lined with a refractory material containing only an oxide and/or a nitride, and wherein the skeleton is placed in a crucible made of an oxide or a nitride.

12. The method according to claim 8, wherein at least either the refractory material of the furnace or the crucible employed in the step of infiltrating the skeleton is formed of a carbonaceous material, and wherein the infiltrating material and the skeleton are isolated from the carbonaceous material by a plate, a block or power of $Al_2O_3$.

13. The method according to claim 8, wherein the step of forming the skeleton employs a split outer mold.

14. A method of manufacturing a contact containing 40 to 55% by volume of a conductive material containing Cu as a principal component and 45 to 60% by volume of an arc-proof material containing TiC or VC as a principal component for a vacuum interrupter, said method comprising the steps of:

mixing powder of the arc-proof material having a particle size in the range of 0.3 to 3 $\mu$m, powder of Cu and paraffin to prepare a mixture;

molding the mixture prepared by the mixing step to form a skeleton; and infiltrating the skeleton formed by the molding step with a conductive material;

wherein the amount of the powder of Cu corresponds to a Cu content in the range of 16 to 43% by volume relative to the sum of the respective amounts of the arc-proof material and the powder of Cu, and the amount of the paraffin corresponds to a paraffin content in the range of 5 to 30% by volume relative to the sum of the respective amounts of the arc-proof material, the paraffin and the powder of Cu, and wherein the infiltrating step is carried out in an evacuated atmosphere of a pressure not higher than $1\times10^{-1}$ Pa.

15. The method according to claim 14, wherein the powder of Cu processed in the mixing step has a particle size is equal to or less than 100 $\mu$m.

16. The method according to claim 15 further comprising a deparaffinizing step to be carried out after the molding step and before the infiltrating step to evaporate and remove the paraffin from the molding by heating the molding at a temperature in the range of 300 to 500° C. for 10 min or longer in a nitrogen atmosphere;

wherein, in the infiltrating step, the molding is heated at a temperature in the range of 1100 to 1200° C. in a vacuum, and the conductive material contains Cu as a principal component is infiltrated into the skeleton.

17. The method according to claim 14 further comprising a deparaffinizing step for evaporating and removing the paraffin from the molding by holding the molding at a temperature of 300° C. or above and not higher than the melting point of the conductive material in a hydrogen atmosphere; and a dehydrogenating step for dehydrogenating the molding by holding the molding in a vacuum at a temperature not lower than 900° C. and not higher than the melting point of the conductive material infiltrated into the molding for 30 min or longer;

wherein the deparaffinizing step and the dehydrogenating step are carried out after the molding process and before the infiltrating step, and wherein, in the infiltrating step the molding is heated at a temperature in the range of 1100 to 1200° C. to infiltrate the molding with the conductive material containing Cu as a principal component.

18. The method according to claim 14 further comprising a deparaffinizing step to be carried out after the molding step and before the infiltration step to extract and remove the paraffin from the molding by immersing the molding for a predetermined time in a hydrocarbon cleaning liquid having a boiling point in the range of 50 to 200°0 C. and heated at a temperature not lower than 40° C. and not higher than the boiling point thereof;

wherein, in the infiltration step, the molding is heated at a temperature in the range of 1100 to 1200° C. to infiltrate the molding with the conductive material containing Cu as a principal component.

19. The method according to claim 18, wherein the deparaffinizing step includes:

a first stage in which the molding is immersed in a first cleaning liquid for a predetermined time to extract the paraffin therefrom; and a second stage in which the molding is immersed in a second cleaning liquid of a paraffin concentration lower than that of the first cleaning liquid in a state after the first cleaning liquid has been used for extracting the paraffin from the molding in the first stage.

20. The method according to claim 14, wherein, in the mixing step, 0.1% by weight or below of Co, 0.1% by weight or below of Fe, 0.3% by weight or below of Ni or 3% by weight or below of Cr relative to the sum of amounts of the mixture is added.

21. The method according to claim 14, wherein the amount of the infiltrating material used in the infiltrating step is equal to 100 to 110% of an amount the same necessary for filling up pores in the molding.

22. The method according to claim 14, wherein the mold employed in the molding step to form the molding by molding the mixture has a molding cavity capable of forming the molding in the shape of a disk, and the molding cavity is tapered so that the diameter of one end thereof through which the molding is taken out of the mold is greater than that of the other end thereof.

* * * * *